US009701133B2

(12) United States Patent
Wilsher et al.

(10) Patent No.: US 9,701,133 B2
(45) Date of Patent: Jul. 11, 2017

(54) DYNAMIC LIGHT EMITTING DIODE (LED) PRINT BAR POSITIONING SYSTEM AND METHOD

(71) Applicant: Xerox Corporation, Norwalk, CT (US)

(72) Inventors: Michael John Wilsher, Herts (GB); Richard David Emms, Welwyn Garden City (GB); Chistopher Pearce, Herts (GB); Vinoth Kumar Ganesan, Tamil Nadu (IN)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/834,811

(22) Filed: Aug. 25, 2015

(65) Prior Publication Data

US 2017/0057247 A1 Mar. 2, 2017

(51) Int. Cl.
*B41J 2/44* (2006.01)
*B41J 2/45* (2006.01)

(52) U.S. Cl.
CPC ..... *B41J 2/45* (2013.01)

(58) Field of Classification Search
CPC ..... B41J 2/44; B41J 2/451
See application file for complete search history.

(56) References Cited

U.S. PATENT DOCUMENTS

2016/0246242 A1* 8/2016 Ganesan ..... B41J 2/45

FOREIGN PATENT DOCUMENTS

JP 05318826 A * 12/1993

* cited by examiner

*Primary Examiner* — Matthew Luu
*Assistant Examiner* — Patrick King
(74) *Attorney, Agent, or Firm* — Simpson & Simpson, PLLC

(57) ABSTRACT

A mount for a light emitting diode print bar removably installable in a printer including an open end having a first curved mounting surface and a closed end oppositely disposed relative to the open end and including an opening, the opening having a second curved mounting surface. A projection of the first curved mounting surface substantially coincides with the second curved mounting surface and the light emitting diode print bar is arranged to pivot about the first and second curved mounting surfaces within the mount.

14 Claims, 10 Drawing Sheets

DYNAMIC LIGHT EMITTING DIODE (LED) PRINT BAR POSITIONING SYSTEM AND METHOD

TECHNICAL FIELD

The presently disclosed embodiments are directed to providing a system and method for positioning a light emitting diode (LED) print bar, more particularly to a system and method for dynamically positioning a datum for a LED print bar, and even more particularly to a system and method having an curved surface used to dynamically positioning datum for a LED print bar.

BACKGROUND

LED print bars used in a variety of printing systems must be moved away from a photoreceptor for cleaning/maintenance operations and during replacement. When the print bar is returned to its operating position, it must be restored to substantially its original position relative to the x, y and z planes or directions, and by extension relative to the photoreceptor. For example, a LED print bar including a SELFOC® lens arranged to focus an image on the photoreceptor must be positioned typically within +/−50 microns of its ideal location in order to satisfy image quality requirements, as SELFOC® lenses typically have very short focal lengths. Unfortunately, typical or known mechanical arrangements rely upon mechanisms that can constrain the LED print bar thereby restricting accurate positioning of the print bar, e.g., print bars become bound in a tilted orientation thereby effecting the alignment and position of the print bar relative to the photoreceptor.

Known print bar locating means include some x and y direction degrees of freedom. However, such systems fail to also control the critical positioning in the z direction, i.e., the distance between the SELFOC® lens and the photoreceptor. Failing to accurately control the z plane prevents the proper focusing of an image on the photoreceptor thereby degrading image quality.

In short, known systems may position the print bar in some directions; however, those systems do not permit relaxed tolerances on components used for position control, and do not permit unassisted settling of the print bar within a system used to align and position the print bar relative to the photoreceptor.

In some known systems, the LED print bar has features which allow x and y direction positioning via a hole at one end of the print bar and a slotted hole at the other end, and the mount has a small amount of x and y direction freedom to accommodate pick-up on the location features and subsequent datum location. However if the LED print bar is held firmly in a mount mechanism, the angle of the mount mechanism relative to the datum pins may cause the print bar to not settle correctly on the z datum surface resulting in an inaccuracy in the positioning of the LED print bar relative to the photoreceptor, e.g., a drum surface, and subsequent focus degradation. Moreover, simply providing the mount more freedom of movement may not cause it to pick up on the locating pins or, because of the mount and print bar's high mass, may not settle on the z datum surface reliably.

FIGS. 1 and 2 depict known systems for locating LED print bar 50 relative to photoreceptor 52. FIG. 1 depicts the proper seating or positioning of print bar 50. Pin assembly 54 includes pin datum surfaces 56 and 58, while print bar 50 includes LED datum surfaces 60 and 62. Pin 64 is positioned within opening 66 in print bar 50 such that pin datum surface

56 fully contacts LED datum surface 60 and pin datum surface 58 fully contacts LED datum surface 62. Thus, pin controlled distance 68 is properly established. It should be appreciated that pin controlled distance 68 is the distance from front surface 70 of print bar 50 to pin feature 72, e.g., a mounting surface. Pin feature 72 in turn locates off of a feature (not shown) which is associated with photoreceptor 52, e.g., a bearing or a mounting structure. The foregoing arrangement controls the critical distance between front surface 74 of SELFOC® lens 76 and photoreceptor 52, i.e., distance 78.

The foregoing system is unfortunately prone to misalignment resulting in the condition depicted in FIG. 2. When print bar 50 is positioned about pin 64, tilt of print bar 50 results in improper alignment of LED datum surfaces 60 and 62 and pin datum surfaces 56 and 58. The foregoing condition results in a change to the critical distance between front surface 74 of SELFOC® lens 76 and photoreceptor 52, i.e., distance 80 shown in FIG. 2 is greater than the ideal distance 78 shown in FIG. 1. It should be appreciated that tilt in the opposite direction is also possible and would result in distance 80 being less than distance 78. As can be seen in FIG. 2, when LED print bar 50 does not sit on both pin datums 56 and 58, a change in from distance 78 to distance 80 occurs, i.e., a change in the critical print bar to photoreceptor distance. The foregoing defect can occur if LED print bar 50 is constrained in its mount (not shown) as the mount has a fixed pivot point relative to its frame (not shown) (See FIG. 3 for an example of a mount relative to a frame). If pin datums 56 and 58 on pin 64, i.e., the pin responsible for aligning the print bar in the x and y directions, are not both engaged with print bar datums 60 and 62, respectively, print bar 50 will not be at the correct angle and hence distance 80 is greater than distance 78. In order to maintain acceptable image focus on the photoreceptor, and thereby printing performance, distance 78 must be controlled within or better than +/−50 um.

The present disclosure addresses all these problems in a practical and cost effective method.

SUMMARY

Broadly, the apparatus and methods discussed infra provide a LED print bar that is provided a degree of freedom in a mount device allowing low inertial movement of the LED print bar and hence that ability to accurately settle on a Z datum surface.

According to aspects illustrated herein, there is provided a mount for a light emitting diode print bar removably installable in a printer including an open end having a first curved mounting surface and a closed end oppositely disposed relative to the open end and including an opening, the opening having a second curved mounting surface. A projection of the first curved mounting surface substantially coincides with the second curved mounting surface. The mount allows free movement of the light emitting diode print bar.

According to aspects illustrated herein, there is provided a light emitting diode print bar assembly removably installable in a printer including a mount having an open end including a first curved mounting surface and a closed end oppositely disposed relative to the open end and including an opening, the opening having a second curved mounting surface. A projection of the first curved mounting surface substantially coincides with the second curved mounting surface. The light emitting diode print bar assembly allows free movement of the light emitting diode print bar.

A mount for a print bar removably installable in a printer including an open end having an open end and a closed end. The open end includes a first curved mounting surface, while the closed end is oppositely disposed relative to the open end and includes an opening. The opening includes a second curved mounting surface. A projection of the first curved mounting surface substantially coincides with the second curved mounting surface.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
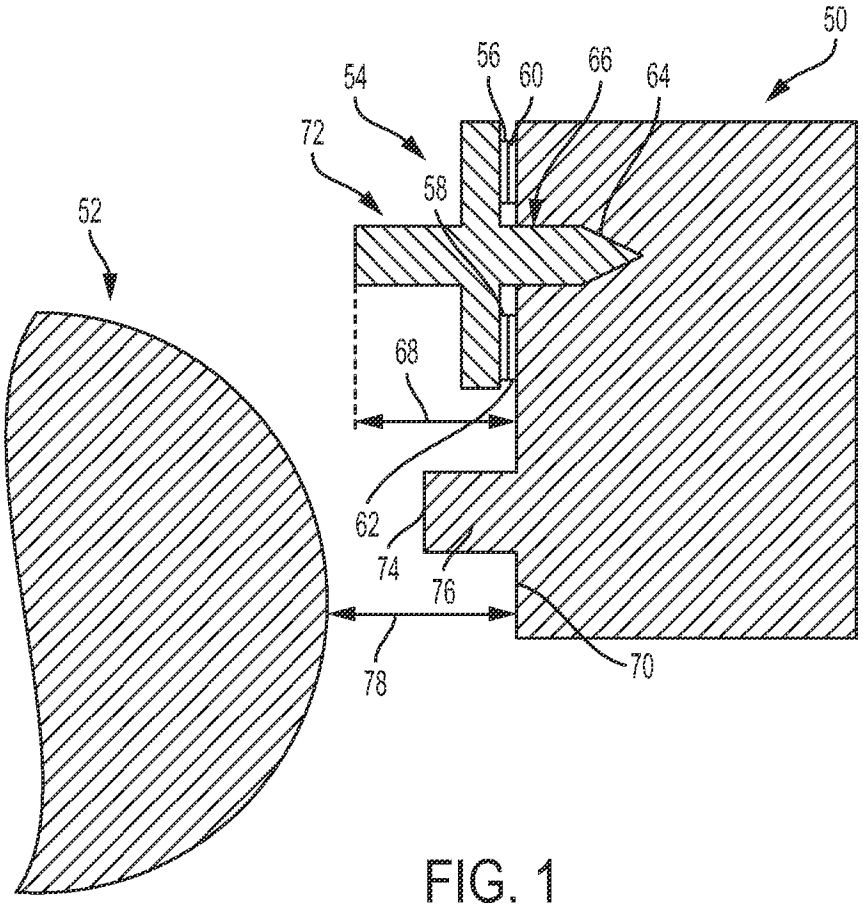
FIG. 1 PRIOR ART
FIG. 1 is a cross sectional view of a prior art system for aligning a print bar relative to a photoreceptor wherein the print bar is properly aligned.

At the outset, it should be appreciated that like drawing numbers on different drawing views identify identical, or functionally similar, structural elements of the embodiments set forth herein. Furthermore, it is understood that these embodiments are not limited to the particular methodologies, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "average" is intended to be broadly construed to include any calculation in which a result datum or decision is obtained based on a plurality of input data, which can include but is not limited to, weighted averages, yes or no decisions based on rolling inputs, etc. Furthermore, as used herein, "average" and/or "averaging" should be construed broadly to include any algorithm or statistical process having as inputs a plurality of signal outputs, for any purpose. A "device useful for digital printing" or "digital printing" broadly encompasses creating a printed output using a processor, software and digital-based image files. It should be further understood that xerography, for example using light emitting diodes (LEDs) or LED print bars, is a form of digital printing.

As used herein, "process direction" is intended to mean the direction of media transport through a printer or copier, while "cross process direction" is intended to mean the perpendicular to the direction of media transport through a printer or copier. The use of "x" axis, direction and plane are intended to represent the process direction and planes oriented thereon, the use of "y" axis, direction and plane are intended to represent the cross process direction and planes oriented thereon, while the use of "z" axis, direction and plane are intended to represent the direction corresponding to the distance between a LED print bar and a photoreceptor and planes oriented thereon. As used herein, "x", "y" and "z" coordinate axes are used to refer to particular orthogonal directions as depicted in the various figures. With respect to the term "real time", for human interactions we mean that the time span between a triggering event and an activity in response to that event is minimized, while in a computer context we mean that data manipulation and/or compensation which occurs with little or no use of a processor, thereby resulting in efficient data manipulation and/or compensation without added processor overhead, such as delaying raw data transmission without any computational analysis of the same.

Furthermore, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper," "paper," and "media" refer to, for example, paper, transparencies, parchment, film, fabric, plastic, photo-finishing papers or other coated or non-coated substrate media in the form of a web upon which information or markings can be visualized and/or reproduced.

As used herein, an "image bearing surface" is intended to mean any surface or material capable of receiving an image or a portion of an image, e.g., a photoreceptor drum, a photoreceptor belt, an intermediate transfer belt, an intermediate transfer drum, an imaging drum, or a document. An "image transfer article" or "substrate adapted for image transfer", as used herein, is intended to mean any article capable of receiving an image or a portion of an image for transfer thereafter to a substrate or media, e.g., a photoreceptor belt or a photoreceptor drum, while "a substrate adapted for image transfer" as used herein is intended to mean any substrate used to form an image transfer article and capable of performing the function of image transfer. As used herein, "image" or "printed image" is intended to be broadly construed as any picture, text, character, indicia, pattern or any other printed matter. Printed images can include but are not limited to logos, emblems and symbols.

A "light emitting diode print bar" or "LED print bar" is a linear array of light emitting diodes used to generate a pattern of illumination to form an image on an image bearing surface such as a photoreceptor.

Moreover, "mechanically coupling" or "mechanically coupled", as used herein, means fastening of two objects indirectly or directly such that a first of the objects, e.g., a surface of a rigid object, is able to facilitate maintenance of a shape of a second of the objects, e.g., a flexible object. Mechanical coupling may allow for some independent movement of the second object relative to first object at a location where the first object and the second object are mechanically coupled together if a force is applied to the second object at the location.

A variety of characteristics are described as "substantially" that characteristic. The following describes how such terms should be understood. For example, with respect to curvatures, "substantially circular", as used herein, means a surface having at least one cross sectional shape that is circular within the tolerances of manufacturing processes, "substantially elliptical" means a surface having at least one cross sectional shape that is elliptical within the tolerances of manufacturing processes, "substantially parabolic" means a surface having at least one cross sectional shape that is parabolic within the tolerances of manufacturing processes, and "substantially hyperbolic" means a surface having at least one cross sectional shape that is hyperbolic within the tolerances of manufacturing processes. "Substantially parallel" is intended to mean elements parallel relative to each other within the tolerances of manufacturing processes, while "substantially orthogonal" is intended to mean elements positioned at a ninety degree angle relative to each other within the tolerances of manufacturing processes.

Figure 6:
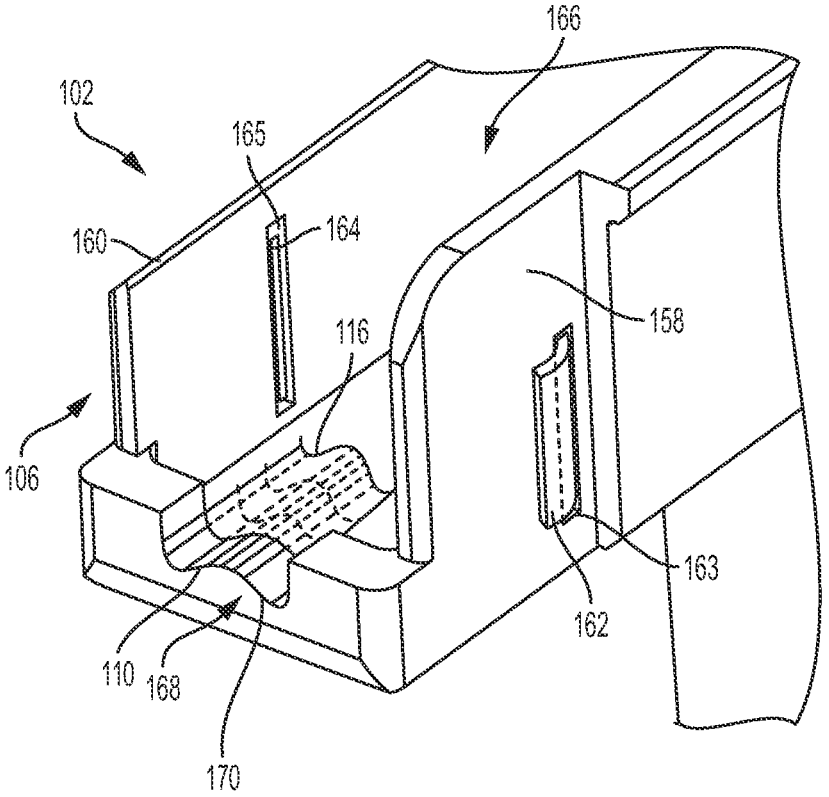
FIG. 6 is a perspective view an embodiment of a present mount for a LED print bar showing an open end including a curved mounting surface.
Figure 7:
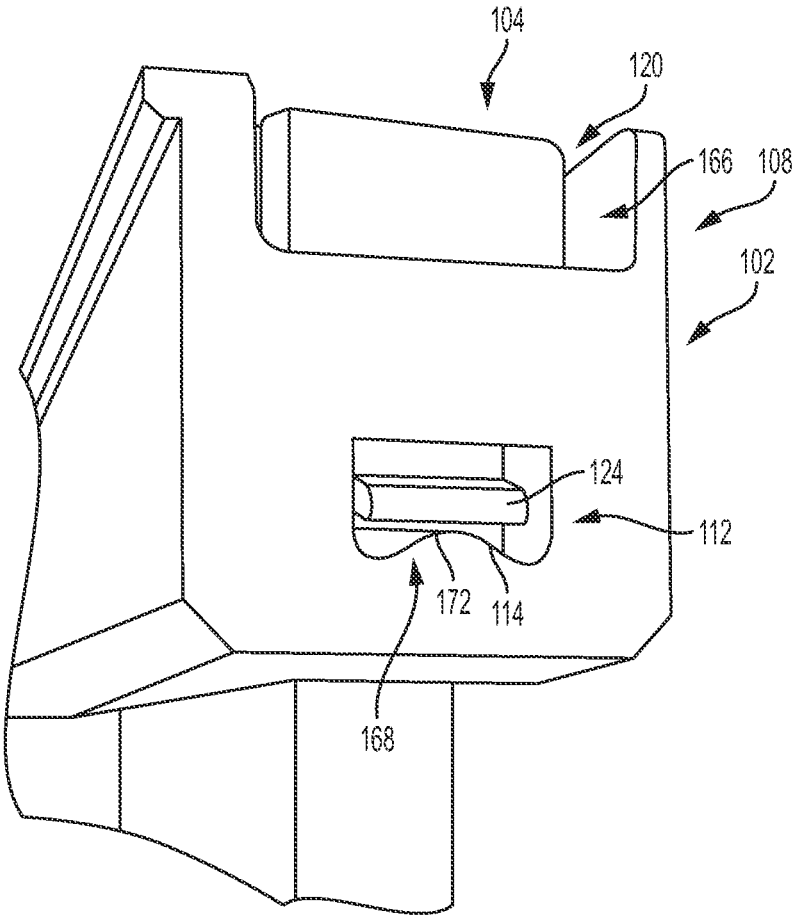
FIG. 7 is a perspective view an embodiment of a present mount with a LED print bar positioned therein showing a closed end including a curved mounting surface.
Figure 8:
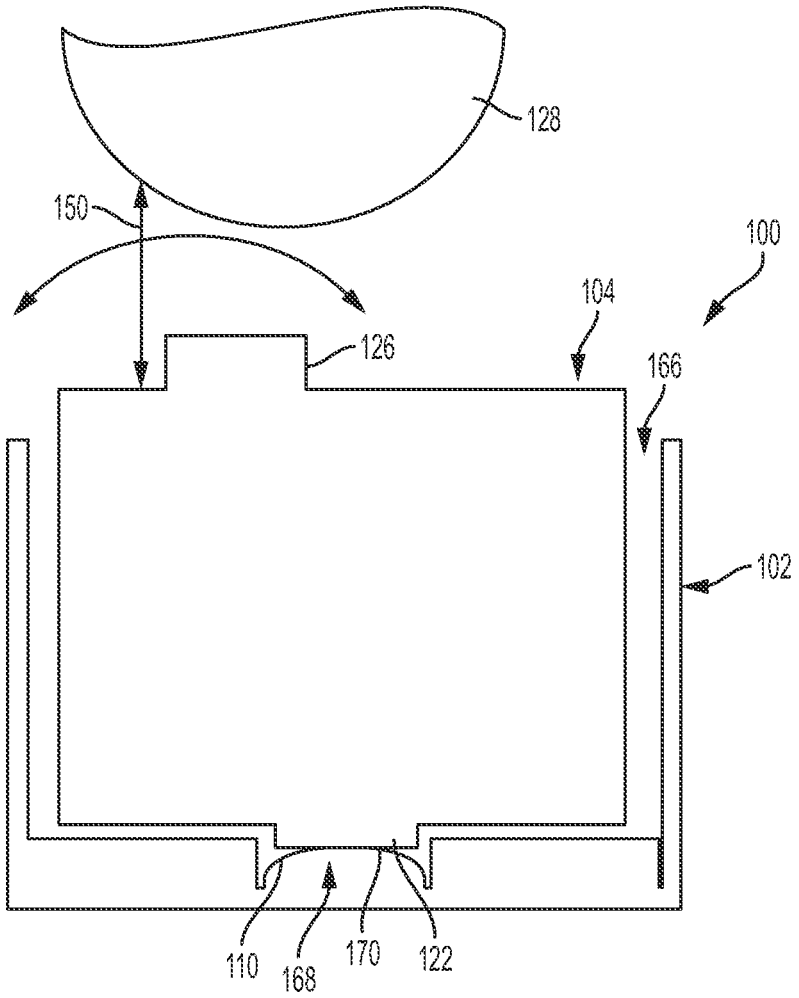
FIG. 8 is a simplified end view of an embodiment of a present mount with a LED print bar positioned therein showing the permitted movement of the print bar within the mount due to the interaction of a print bar extension with a curved mounting surface.
Figure 9:
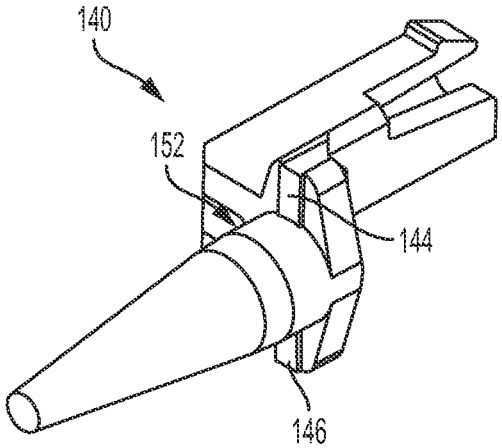
FIG. 9 is a perspective view of an embodiment of a locating pin having two datum surfaces arranged to contact complimentary datum surfaces on a LED print bar.
Figure 10:
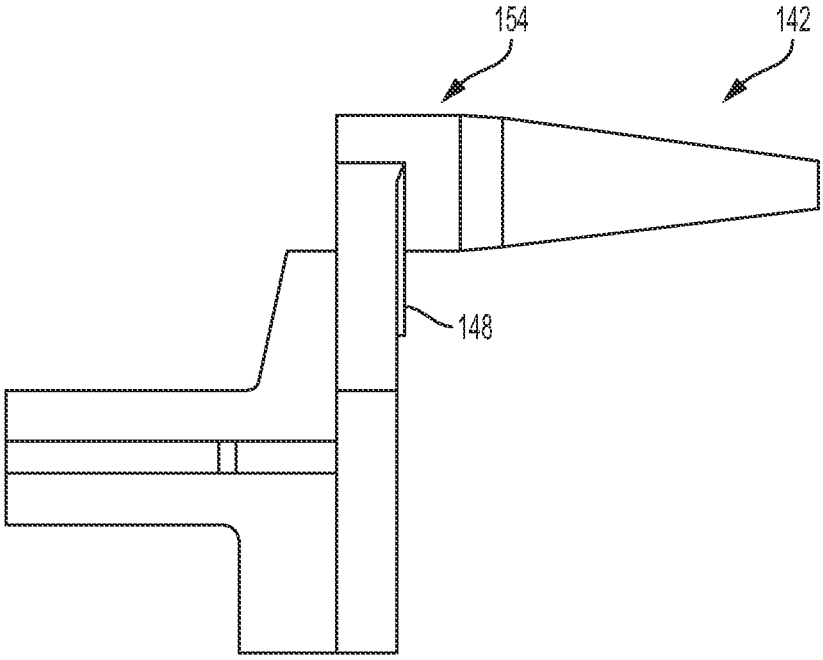
FIG. 10 is a side elevational view of an embodiment of a locating pin having one datum surface arranged to contact a complimentary datum surface on a LED print bar; and, FIG. 11 is a simplified front elevational view of an embodiment of a LED print bar showing a mounting hole, a mounting slot and three datum surfaces.
Figure 11:
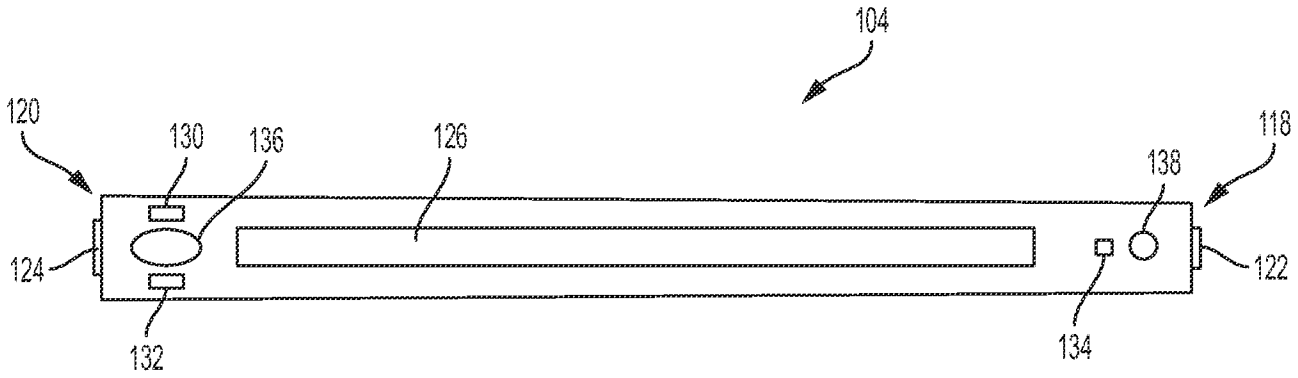

A "projection", as used herein, is intended to mean a theoretical extension of a surface or a feature in one or more directions. A "projection" does not exist as a physical structure but instead represents where a physical structure of an extension of a surface or feature would be located. An example of a "projection" is represented in broken lines in FIG. 6 as projection 116 of first curved mounting surface 110. Projection 116 represents where a surface would exist if first curved mounting surface 110 were extended in a direction towards second curved mounting surface 114. Moreover, "substantially coincides", as used herein with respect to a "projection", is intended to mean that the relevant projection, when extended to reach the referenced surface, occupies the same position in space as the referenced surface, within the tolerance of manufacturing processes. For example, as shown in FIG. 7, projection 116 of first curved mounting surface 110 substantially coincides with second curved mounting surface 114, or in other words, projection 116, if extended a sufficient distance, occupies the same position in space as second mounting surface 114.

An "extension", as used herein, is intended to mean a physical protrusion that extends from a surface or feature in one or more directions. For example, first extension 122 extends from light emitting diode print bar 104 in a direction substantially perpendicular from first end 118. First extension 122 is not a theoretical projection, but a physical protrusion. A "curved mounting surface", as used herein, is intended to mean a surface or portion of a surface having a curvature or curved shaped whereon another element, e.g., an extension, contacts and is acted upon. For example, first extension 122 contacts first curved mounting surface 110 and the position of first extension 122 depends on its interaction with mounting surface 110.

"A first curvature substantially the same as a second curvature" and "a second curvature substantially the same as a first curvature" is intended to mean that the shape of each curvature is the same as the other curvature within the tolerances of manufacturing processes. "At least partially positionable within a volume" is intended to mean that at least a portion of an object, e.g., a print bar, fits within an open volume of another object, e.g., a mount.

"Releasably secured", as used herein, is intended to mean a first element is attached to a second element such that the first element may be freed from such attachment under particular conditions. For example, a metal plate may be releasably secured to a wall with a magnet, where the plate is freed from attachment when a force greater than the magnetic force is applied to the plate. "Adjacent" is intended to mean one element is adjoining, being in contact at some point or line, located next to, bordering or contiguous with another element. For example, if element A has first and second ends, and element B is adjacent the first end, element B may be located next to element A, or element B may be closer to the first end than element B is relative to the second end.

"Within the tolerance of manufacturing processes" is intended to mean that the referenced characteristic is controlled within the capabilities of manufacturing processes presently known and as developed in the future. For example, "substantially circular" is a surface having at least one cross sectional shape that is circular, where the accuracy of the circular shape is controlled by the capabilities of tooling, operators, etc.

It should be understood that the use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, although any methods, devices or materials similar or equivalent to those described herein can be used in the practice or testing of these embodiments, some embodiments of methods, devices, and materials are now described.

The present disclosure describes a system and method comprising a curved surface used to dynamically position a LED print bar. Broadly, present system 100 comprises mount 102 for light emitting diode print bar 104. Mount 102 comprises open end 106 and closed end 108. Open end 106 comprises first curved mounting surface 110, while closed end 108 is oppositely disposed relative to open end 106 and comprises opening 112. Opening 112 comprises second curved mounting surface 114. Projection 116 of first curved mounting surface 110 substantially coincides with second curved mounting surface 114. LED print bar 104 is free to rotate or rock in mount 102 about mounting surfaces 110 and 114.

Light emitting diode print bar 104, in some embodiments, comprises first end 118 and second end 120. First end 118 comprises first extension 122 and second end 120 comprises second extension 124. When assembled, first extension 122 contacts first curved mounting surface 110 and second extension 124 contacts second curved mounting surface 114. As described above, LED print bar 104 may include SELFOC® lens 126 arranged to form an image of the illuminated LEDs on photoreceptor 128. In such embodiments, it is advantageous to provide precisely toleranced datums 130, 132 and 134 on print bar 104 to establish where the focal length of lens 126 falls in space relative to print bar 104.

It should be appreciated that the foregoing interaction may be arranged differently. For example, the curved surfaces may be formed as extensions from the print bar and the complimentary mounting surfaces would then be linear in shape. Moreover, only a single end of the print bar may include a substantially linear extension in combination with a curved mounting surface on the mount. In such embodiments, means for permitting the rocking of the print bar must be include at the opposite end of the print bar, e.g., a pin or wedge.

LED print bar 104 includes features that assist with the proper location of the print bar relative to photoreceptor 128. In some embodiments, print bar 104 includes slotted hole 136 and circular hole 138. Print bar datums 130 and 132 are located adjacent slotted hole 136, while print bar datum 134 is located adjacent circular hole 138. The combination of slotted hole 136 and circular hole 138 permits the placement of LED print bar 104 on pin 140 for initial positioning and then on pin 142 for final alignment and location. Although the sizes and positions of both slotted hole 136 and circular hole 138 are tightly toleranced, circular hole 138 is more highly toleranced to ensure that the inboard and outboard movement, i.e., movement in the y or cross process direction and x or process direction movement are accurately controlled. Thus, it should be appreciated that the interaction of the pins with the slotted and circular holes controls the x and y direction positioning of print bar 104, while the datums control the z direction positioning of print bar 104. The positions of pins 140 and 142 relative to photoreceptor 128 and the foregoing interaction of pins 140 and 142 and slotted and circular holes 136 and 138, respectively, control the position of print bar 104 relative to photoreceptor 128. Moreover, the foregoing interaction of pin datums 144, 146 and 148 and print bar datums 130, 132 and 134, respectively, also control the position of print bar 104 relative to photoreceptor 128. Collectively, the foregoing elements control and ensure the proper distance between print bar 104 and photoreceptor 128, i.e., critical distance 150, which is the distance from any of print bar datums 130, 132 or 134 to the surface of photoreceptor 128 along the optical axis.

Figure 2:
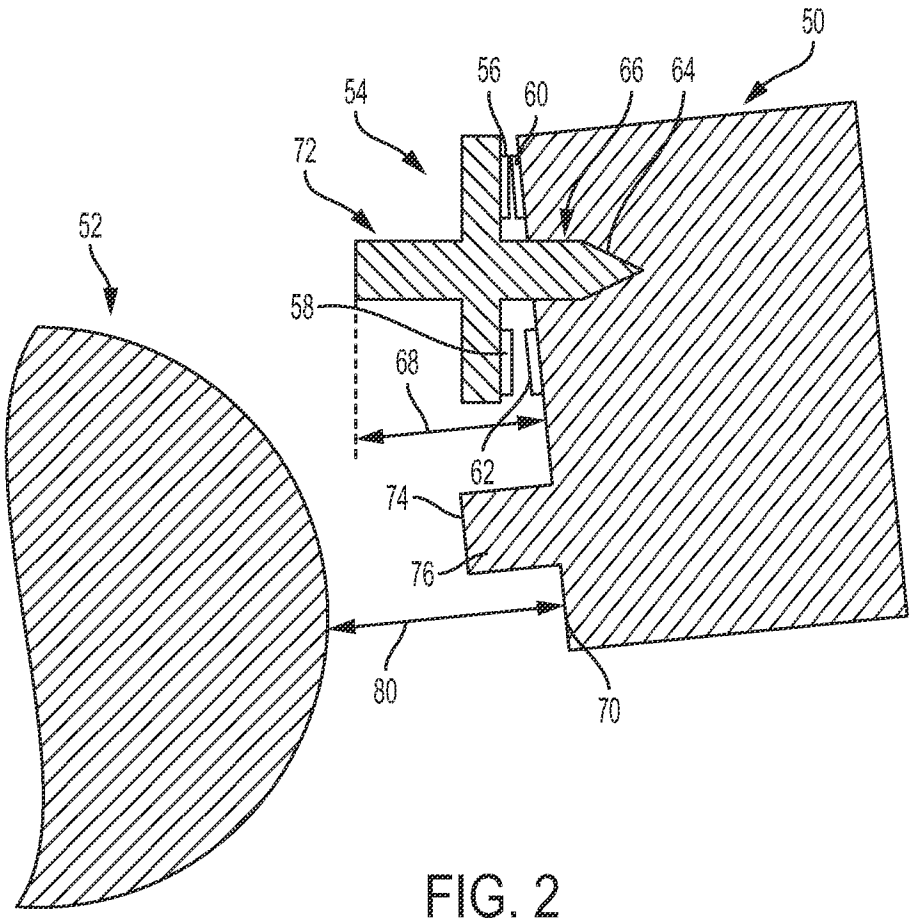
FIG. 2 PRIOR ART
FIG. 2 is a cross sectional view of a prior art system for aligning a print bar relative to a photoreceptor wherein the print bar is improperly aligned due to a tilt condition.
Figure 3:
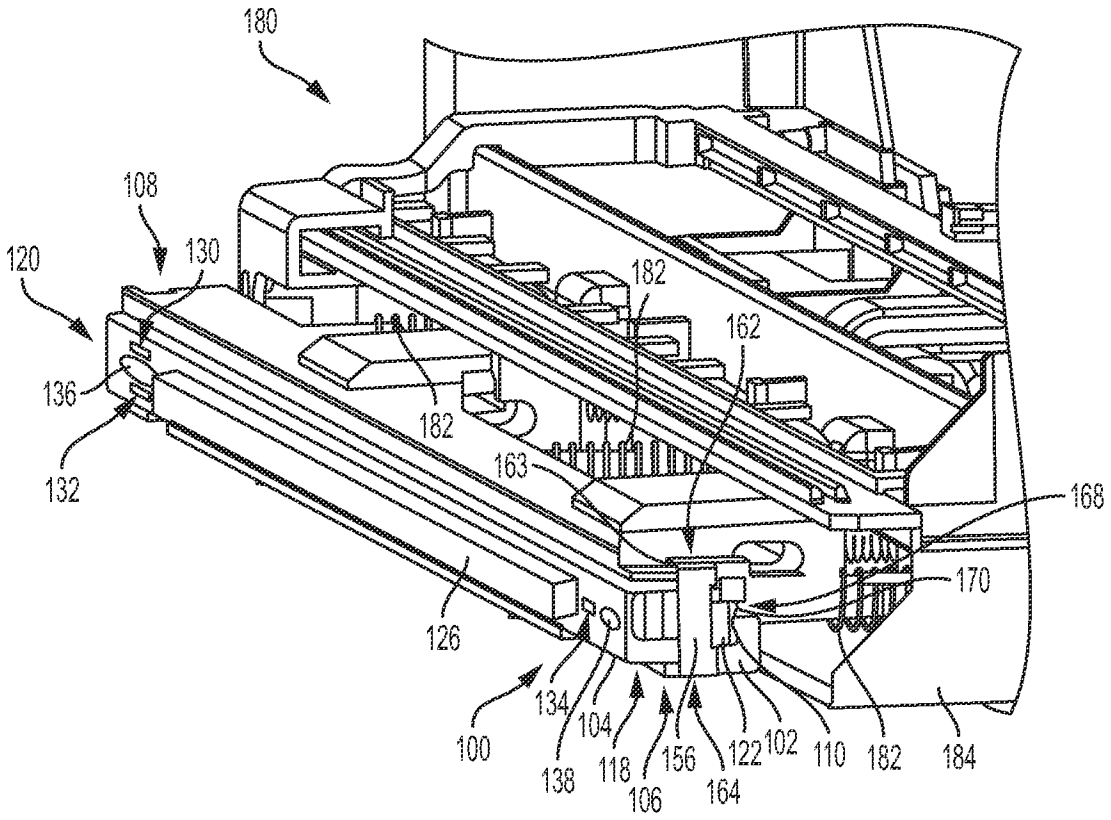
FIG. 3 is a perspective view of a portion of a printer system showing a LED print bar mounted within a mount wherein the mount is moveably secured to a fixed portion of the printer system.
Figure 4:
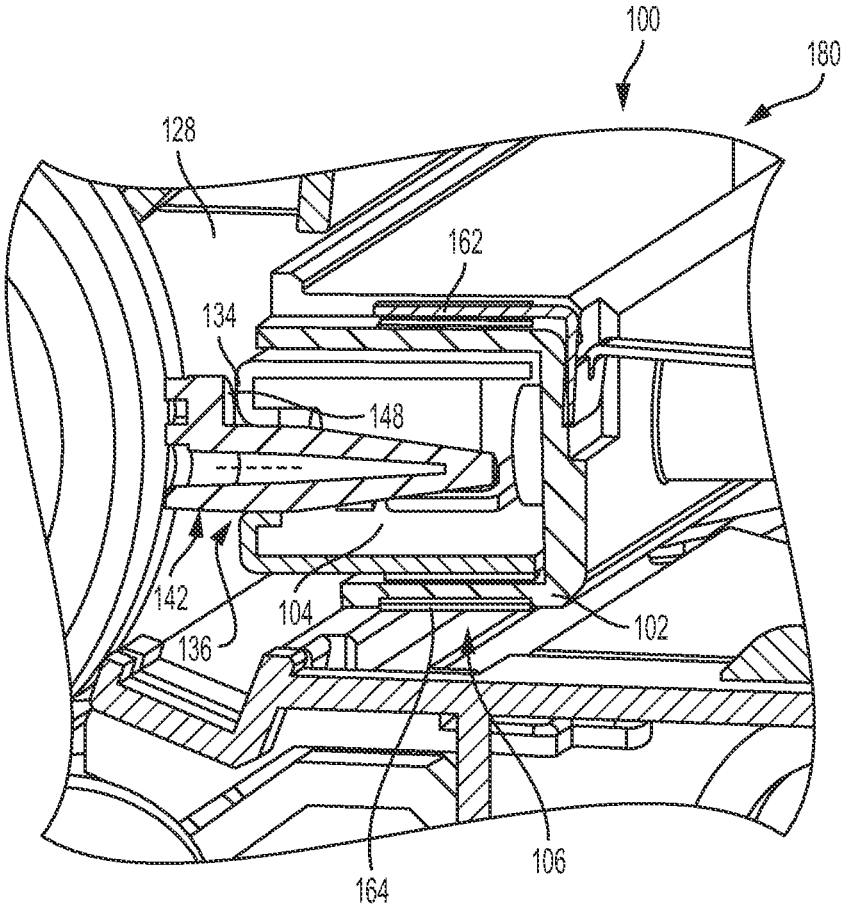
FIG. 4 is a cross sectional view of a portion of the perspective view depicted in FIG. 3 wherein the interface between a locating pin and the LED print bar is visible.
Figure 5:
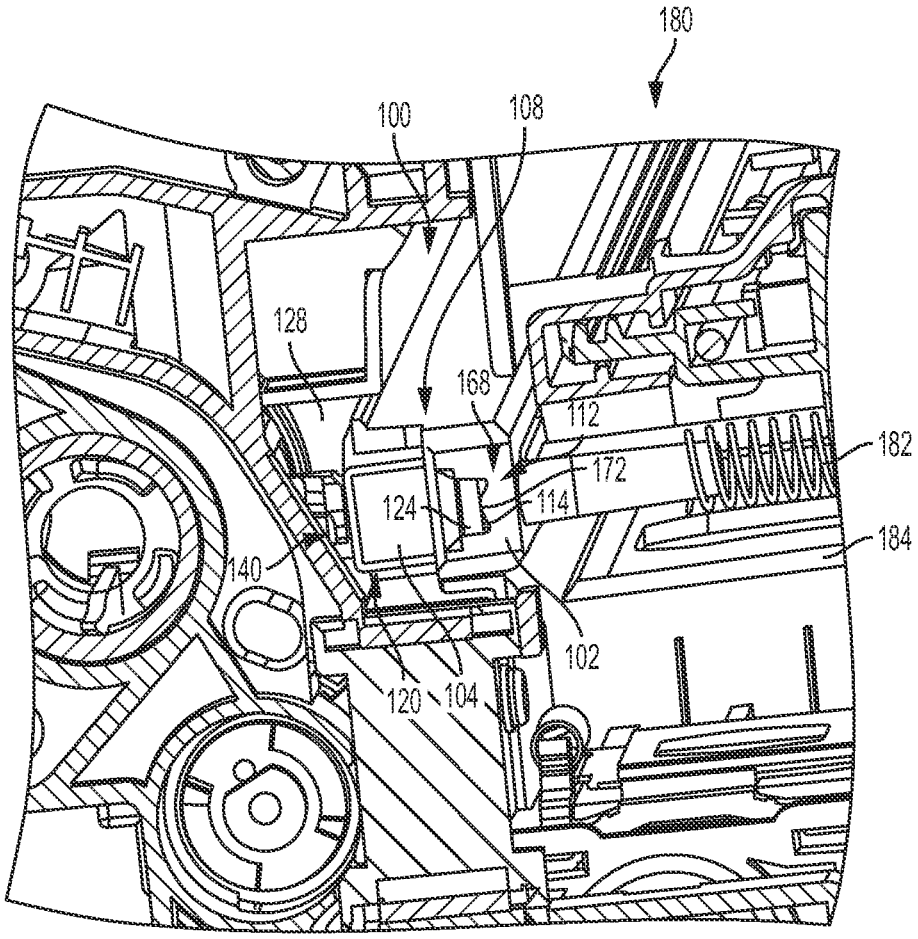
FIG. 5 is a perspective view of the portion of the printer system depicted in FIG. 3 shown from the opposite end of the LED print bar.

In view of the foregoing, it should be appreciated that the interaction of pin datums 144 and 146 and print bar datums 130 and 132 control the tilt as depicted in FIGS. 1 and 2, while the interaction of pin datum 148 and print bar datum 134 controls the length of distance 150. The arrangement of pins 140 and 142 also contribute to the final positioning of print bar 104. For example, pins 140 and 142 include substantially cylindrical portions 152 and 154, respectively, which further control the position of print bar 104 via the interaction of portions 152 and 154 with slotted hole 136 and circular hole 138, respectively.

In some embodiments, mount 102 further comprises clip 156 releasably secured adjacent open end 106. Clip 156 is arranged to retain light emitting diode print bar 104 within mount 102. It should be appreciated that clip 156 may take a variety of forms. For example, as depicted in the figures, clip 156 may be a formed piece of sheet metal. Alternatively, clip 156 could be a metal plate secured with fasteners to mount 102. Such embodiments fall within the scope of the claims.

In some embodiments, mount 102 further comprises first side wall 158 and second side wall 160. First side wall 158 extends offset and substantially parallel relative to second side wall 160. First and second side walls 158 and 160, respectively, extend between and substantially orthogonal relative to open and closed ends 106 and 108, respectively.

In some embodiments, clip 156 comprises first end 162 releasably secured to first side wall 158 at first opening 163 and second end 164 releasably secured to second side wall 160 at second opening 165. Clip 156 is adjacent open end 106 and arranged to retain light emitting diode print bar 104 within mount 102. In some embodiments, first and second side walls 158 and 160, respectively, and open and closed ends 106 and 108, respectively, collectively form volume 166. Light emitted diode print bar 104 is at least partially positionable within volume 166. Moreover, it should be appreciated that the distance between first side wall 158 and second side wall 160 is sufficient to receive at least a portion of print bar 104 therebetween. The foregoing arrangement, in part, permits the pivotal or rocking movement of print bar 104 within mount 102.

In some embodiments, at least one of first mounting surface 110 and second mounting surface 114 comprises curvature 168 selected from the group consisting of: substantially circular, substantially elliptical, substantially parabolic and substantially hyperbolic. Depending on the embodiment, one or both of mounting surfaces 110 and 114 comprise a curvature.

In some embodiments, first mounting surface 110 comprises a first curvature 170 and second mounting surface 114 comprises second curvature 172 substantially the same as first curvature 170.

Broadly, the present light emitting diode print bar assembly 180 comprises mount 102 and light emitting diode print bar 104. Mount 102 is biased in a generally linear direction due to the forces provided by springs 182 against frame 184. Thus, it should be appreciated that springs 182 impart a force on mount 102, which through contact between first and second curved mounting surfaces 110 and 114, respectively, and first and second extensions 122 and 124, respectively, biases print bar 104 against datums 144, 146 and 148 of pins 140 and 142. The foregoing arrangement ensures contact between print bar datums 130, 132 and 134 and pin datums 144, 146 and 148, respectively. The freedom of movement of print bar 104 within mount 102, e.g., rocking movement, causes the respective datums on the LED print bar and the pins to settle into contact with each other.

Moreover, the present disclosure includes a method for positioning light emitting diode print bar assembly 180 relative to photoreceptor 128. The method comprises positioning light emitting diode print bar 104 within mount 102 and then contacting first extension 122 with first curved mounting surface 110 and contacting second extension 124 with second curved mounting surface 114. In some embodiments, the method further comprises releasably securing clip 156 adjacent open end 106 to retain light emitting diode print bar 104 within mount 102. Print bar 104 is positioned within mount 102 such that extension 124 falls within opening 112 at closed end 108 of mount 102. Subsequently, clip 156 is releasably secured adjacent open end 106 thereby retaining/securing print bar 104 within mount 102.

The foregoing describes curved mounting surfaces in a mount on which extensions from each end of a LED print bar sit. The mount is only slightly larger than the LED print bar and the print bar is free to rock within the mount along the curved profile, thus allowing the LED print bar via its datums to settle on the datums of the pin responsible for maintaining the print bar position in the z direction, without being constrained by the mount angle. As the print bar is permitted to slightly rock relative to the pins, i.e., about 5-10 degrees in each direction, the interaction between the print bar extensions and the curved mounting surfaces ensures that the pin datums and the print bar datums fully contact each other. Since only the LED print bar is free to move, there is less mass and hence less inertia, and the LED print bar can settle on the z direction datum more easily. The effect of pushing the print bar extensions against a flat surface and/or a constrained mount does not allow the print bar to conform to the pin datums. However, if the mounting surface is curved, the extensions can rock over the curved surfaces and allow the print bar to rock in the mount, and hence conform the print bar to the pin datum responsible for maintaining the z direction. Free space between the side walls of the mount and the curved mounting surfaces allow the LED print bar to rock within the mount and thereby ensure that the datum of the print bar falls on the datum of the pin. In use, the print bar, located against the pin datums, may sit at a different angle than the mount.

It should be appreciated that the present system and method for locating a LED print bar may be used in other printing systems where control of the distance between two elements is necessary. For example, printing systems that use ink jet technology require accurate positioning between the dispensing jets and the media that receives the ink, e.g., the distance between an ink jet print bar and a sheet of paper or an intermediate image transfer surface. In such embodiments, similar pins may be used which comprise positioning datums. The pins may be arranged relative to an image bearing surface. Thus, the distance between the pin datums and the image bearing surface may be accurately controlled. Then, an ink jet print bar comprising print bar datums may be position on the pins in a similar fashion as described above relative to the embodiments comprising a LED print bar. In other words, an ink jet print bar comprising extensions at each end is secured within a mount comprising oppositely disposed and aligned curved surfaces. The extensions engage the curved surfaces and permit the ink jet print bar to rock within the mount to ensure proper alignment and contact between the pin datums and the ink jet print bar datums. The foregoing system and method may be used to control the positioning of the ink jets relative to the media, as well as other systems requiring controlled placement of two elements relative to each other.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A mount for a light emitting diode print bar removably installable in a printer comprising:

an open end comprising a first curved mounting surface; and, a closed end oppositely disposed relative to the open end and comprising an opening, the opening comprising a second curved mounting surface, wherein a projection of the first curved mounting surface substantially coincides with the second curved mounting surface and the light emitting diode print bar is arranged to pivot about the first and second curved mounting surfaces within the mount, and wherein the light emitting diode print bar comprises a first end and a second end, the first end comprising a first extension and the second end comprising a second extension, wherein the first extension contacts the first curved mounting surface and the second extension contacts the second curved mounting surface, and wherein contact between the first and second extensions and the first and second curved mounting surfaces, respectively, allows free movement of the light emitting diode print bar within the mount.

2. The mount of claim 1 further comprising:

a clip releasably secured adjacent the open end and arranged to retain the light emitting diode print bar within the mount.

3. The mount of claim 1 further comprising:

a first side wall; and, a second side wall, wherein the first side wall extends offset and substantially parallel relative to the second side wall, and the first and second side walls extend between and substantially orthogonal relative to the open and closed ends.

4. The mount of claim 3 further comprising:

a clip comprising a first end and a second end releasably secured to the first and second side walls, respectively, adjacent the open end and arranged to retain the light emitting diode print bar within the mount.

5. The mount of claim 3 wherein the first and second side walls and the open and closed ends collectively form a volume, and the light emitted diode print bar is at least partially positionable within the volume.

6. The mount of claim 1 wherein at least one of the first and second mounting surfaces comprises a curvature selected from the group consisting of:

substantially circular, substantially elliptical, substantially parabolic and substantially hyperbolic.

7. The mount of claim 1 wherein the first mounting surface comprises a first curvature and the second mounting surface comprises a second curvature substantially the same as the first curvature.

8. A light emitting diode print bar assembly removably installable in a printer comprising:

a mount comprising:

an open end comprising a first curved mounting surface; and, a closed end oppositely disposed relative to the open end and comprising an opening, the opening comprising a second curved mounting surface, and a light emitting diode print bar comprising a first end and a second end, the first end comprising a first extension and the second end comprising a second extension, wherein a projection of the first curved mounting surface substantially coincides with the second curved mounting surface, and wherein the first extension contacts the first curved mounting surface and the second extension contacts the second curved mounting surface, and wherein contact between the first and second extensions and the first and second curved mounting surfaces, respectively, allows free movement of the light emitting diode print bar within the mount.

9. The light emitting diode print bar assembly of claim 8 further comprising:

a clip releasably secured adjacent the open end and arranged to retain the light emitting diode print bar within the mount.

10. The light emitting diode print bar assembly of claim 8 wherein the mount further comprises:

a first side wall; and, a second side wall, wherein the first side wall extends offset and substantially parallel relative to the second side wall, and the first and second side walls extend between and substantially orthogonal relative to the open and closed ends.

11. The light emitting diode print bar assembly of claim 10 further comprising:

a clip comprising a first end and a second end releasably secured to the first and second side walls, respectively, adjacent the open end and arranged to retain the light emitting diode print bar within the mount.

12. The light emitting diode print bar assembly of claim 10 further comprising:

a light emitting diode print bar, wherein the first and second side walls and the open and closed ends collectively form a volume, the light emitted diode print bar is at least partially positionable within the volume and the light emitting diode print bar is arranged to pivot about the first and second curved mounting surfaces within the mount.

13. The light emitting diode print bar assembly of claim 8 wherein at least one of the first and second mounting surfaces comprises a curvature selected from the group consisting of: substantially circular, substantially elliptical, substantially parabolic and substantially hyperbolic.

14. The light emitting diode print bar assembly of claim 8 wherein the first mounting surface comprises a first curvature and the second mounting surface comprises a second curvature substantially the same as the first curvature.

* * * * *